US007097515B2

(12) United States Patent
Siddiqi et al.

(10) Patent No.: US 7,097,515 B2
(45) Date of Patent: Aug. 29, 2006

(54) SUBSEA ELECTRICAL CONNECTOR

(75) Inventors: Nadeem M. Siddiqi, Houston, TX (US); Stuart John Morrison, Tomball, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 11/039,126

(22) Filed: Jan. 19, 2005

(65) Prior Publication Data

US 2006/0160430 A1 Jul. 20, 2006

(51) Int. Cl.
*H01R 13/24* (2006.01)

(52) U.S. Cl. ..... 439/700

(58) Field of Classification Search ..... 439/700, 439/289, 201, 271, 199, 204
See application file for complete search history.

(56) References Cited

U.S. PATENT DOCUMENTS 1,392,558 A * 10/1921 Darrah et al. ..... 307/9.1
3,521,216 A * 7/1970 Jerair ..... 439/39
4,796,159 A * 1/1989 Miksche ..... 361/832
5,685,727 A * 11/1997 Cairns ..... 439/139
5,722,842 A * 3/1998 Cairns ..... 439/139
5,738,535 A * 4/1998 Cairns ..... 439/138
6,315,461 B1 * 11/2001 Cairns ..... 385/56

* cited by examiner

*Primary Examiner*—Chandrika Prasad
*Assistant Examiner*—Phuongchi Nguyen
(74) *Attorney, Agent, or Firm*—William, Morgan & Amerson, P.C.

(57) ABSTRACT

The present invention is directed to various embodiments of a connector. In one illustrative embodiment, the connector includes a first connector half and a second connector half adapted to be coupled to a power supply source, wherein the first and second connector halves are adapted to, when coupled to one another, define at least one electrical conductive path through the first and second connector halves by contact between at least one conductive member in each of the first and second connector halves, and wherein the first and second connector halves are adapted to be mated or unmated while power is being supplied to at least the second connector half.

42 Claims, 11 Drawing Sheets

SUBSEA ELECTRICAL CONNECTOR

BACKGROUND OF THE INVENTION

1. Field of the Invention

The present invention is generally directed to the field of electrical connectors, and, more particularly, to an electrical connector that may be employed in subsea applications and other wet environments.

2. Description of the Related Art

In many industries, electrical power is supplied to components positioned in a body of water. For example, in the oil and gas industry, power may be supplied to various components or devices positioned on the floor of the ocean. As a specific example, electrical power may be supplied to various valves and electrical instrumentation positioned on or adjacent a Christmas tree or blowout preventer positioned on a subsea wellhead. The power is typically supplied by a power generation unit or plant located on a surface vessel or on a drilling or production platform located above the surface of the ocean. In some cases, the power supply unit may be located on land adjacent the body of water.

Typically, an electrical connector is provided between the power supply unit and each of the subsea components so that, when desired, the power supply may be disconnected if needed. Electrical connectors employed with such subsea components are usually contact-based electrical connectors wherein a conductive electrical flow path is established through the connector halves by contact between one or more electrically conductive components in each connector half. Such contact-based electrical connectors are different from induction-based electrical connectors wherein the conductive flow path is established, at least in part, by the interaction between various electrical fields.

To date, contact-based electrical connectors employed in such wet environments suffer from several deficiencies and cause many problems. For example, with existing subsea contact-based connectors, the power supply must be shut off before mating or unmating the electrical connector. That is, with existing subsea contact-based connectors, the connection cannot be established or broken without shutting off the power supplied to the connector. If a connection is broken with electrical power on, these connectors tend to fail. Such deficiencies with existing subsea connectors cause many problems. In some applications, many such contact-based connectors are employed to provide electrical power to several components on various subsea systems and installations. Such systems may be very complex and, once they reach an operational state, it is undesirable to shut off power to all or substantially all of the system when it is necessary to connect/disconnect power to a particular subsea component.

Troubleshooting various problems is also difficult due to the inability of subsea contact-based connectors to be mated/unmated with the power supply on. For example, if a particular downhole component malfunctions or completely stops working, it may be difficult to determine if the cause of the failure is due, in whole or in part, to the electrical power supplied to the malfunctioning component or other components. In a typical system installed on land, part of the troubleshooting process might involve mating/unmating various electrical connectors that supply power to various components of the land-based system. This mating/unmating process may provide useful information as it relates to determining potential causes of the failure or malfunction and/or eliminating potential causes of the failure or malfunction.

With subsea contact-based connectors, where the electrical connections may not be readily established and broken with the power supply "on," i.e., when the connections are "hot," operating personnel may undertake additional actions as it relates to troubleshooting problems. For example, engineers may review many electrical power schematics in an effort to determine potential causes of the failure. Such a procedure can be very time consuming and somewhat inefficient as it is a less direct method of investigating some problems encountered in many failure situations.

Induction-based connectors also suffer from several deficiencies as it relates to their use in subsea applications. In general, such induction-based connectors have not met the high degree of reliability desired for subsea equipment applications. Moreover, the physical size and expense of such induction-based electrical connectors are drawbacks to their widespread implementation in subsea applications.

The present invention is directed to various devices and methods for solving, or at least reducing the effects of, some or all of the aforementioned problems.

SUMMARY OF THE INVENTION

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

The present invention is directed to various embodiments of a connector. In one illustrative embodiment, the connector comprises a first connector half and a second connector half adapted to be coupled to a power supply source, wherein the first and second connector halves are adapted to, when coupled to one another, define at least one electrical conductive path through the first and second connector halves by contact between at least one conductive member in each of the first and second connector halves, and wherein the first and second connector halves are adapted to be mated or unmated while power is being supplied to at least the second connector half.

In another illustrative embodiment, the connector comprises a first connector half adapted to be coupled to a subsea component, a second connector half adapted to be coupled to the first connector half and means for establishing a contact-based electrical conductive path through the first and second connector halves such that the first and second connector halves may be mated or unmated while electrical power is supplied to at least one of the first and second connector halves.

In yet another illustrative embodiment, the connector comprises a first connector half adapted to be coupled to a subsea component and a second connector half adapted to be coupled to the first connector half, each of the first and second connector halves comprising a body, a stationary conductive member positioned in the body and a movable conductive member positioned in the body, the movable conductive member being adapted to be conductively coupled to the stationary conductive member.

In a further illustrative embodiment, the connector comprises a first connector half adapted to be coupled to a subsea component and a second connector half adapted to be coupled to the first connector half, each of the first and second connector halves comprising a body, a stationary conductive member positioned in the body, a movable conductive member positioned in the body and an intermediate conductive member positioned between the stationary conductive member and the movable conductive member, wherein at least one of the stationary conductive member and the movable conductive member conductively contacts the intermediate conductive member.

BRIEF DESCRIPTION OF THE DRAWINGS

The invention may be understood by reference to the following description taken in conjunction with the accompanying drawings, in which like reference numerals identify like elements, and in which.

Figure 1:
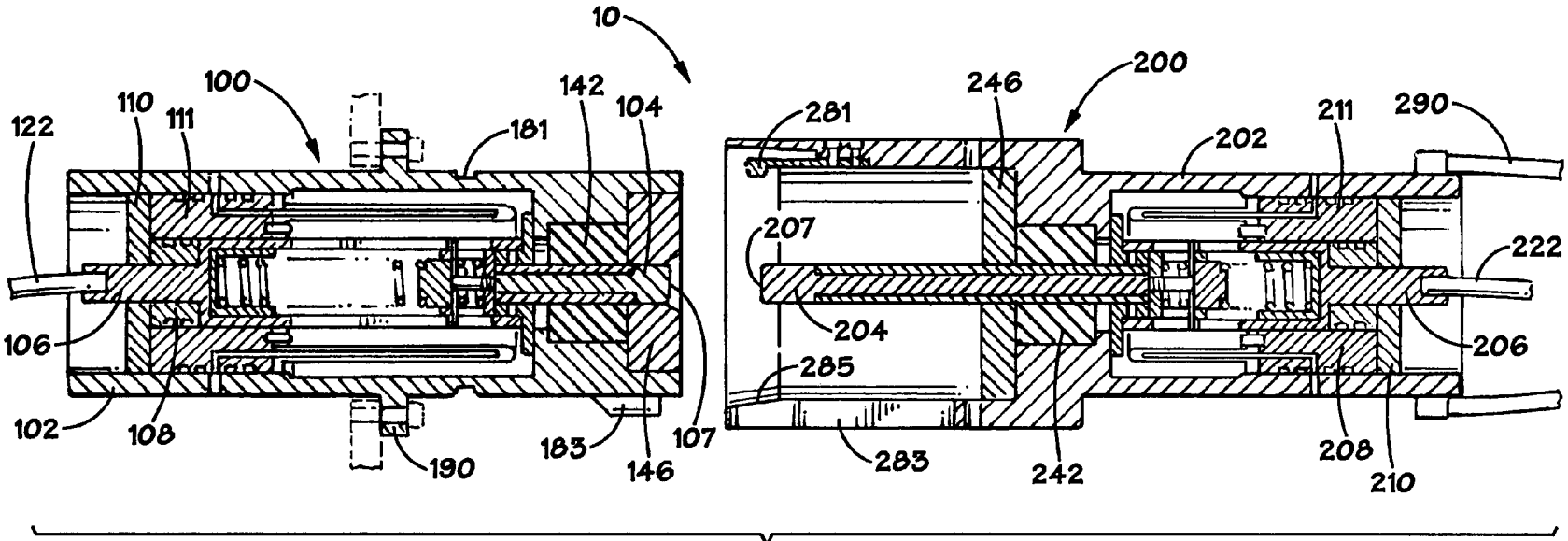
FIGS. 1–3 are cross-sectional views of an illustrative connector in accordance with one illustrative embodiment of the present invention in various stages of engagement.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 2:
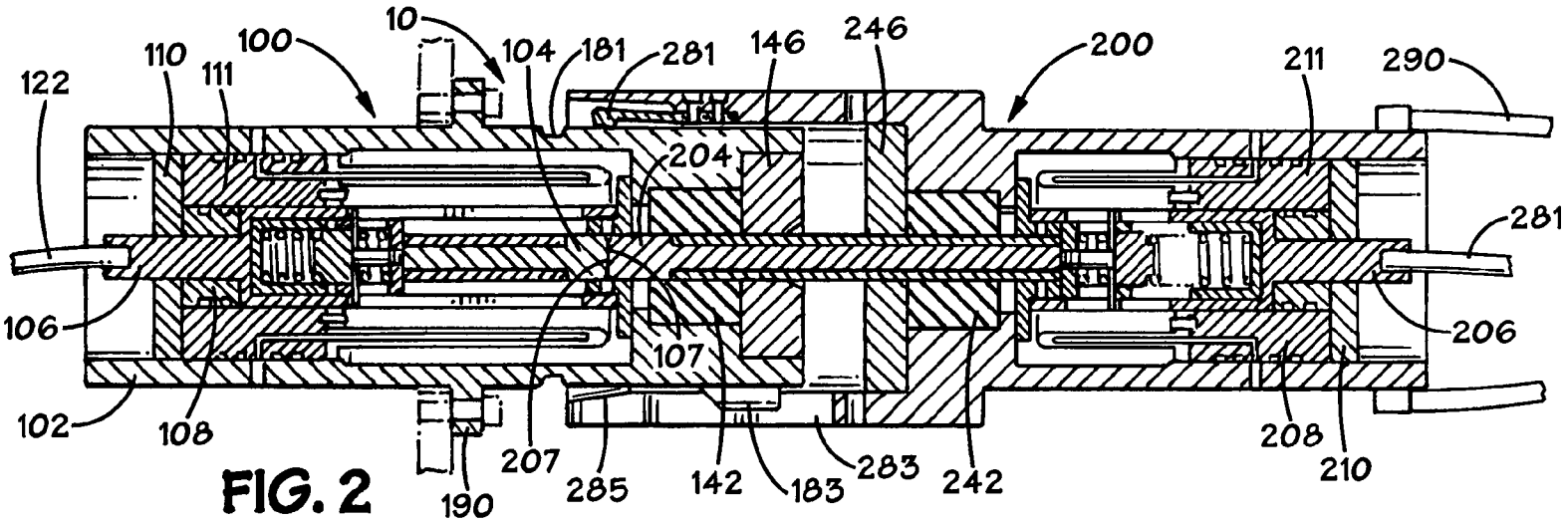
Figure 3:
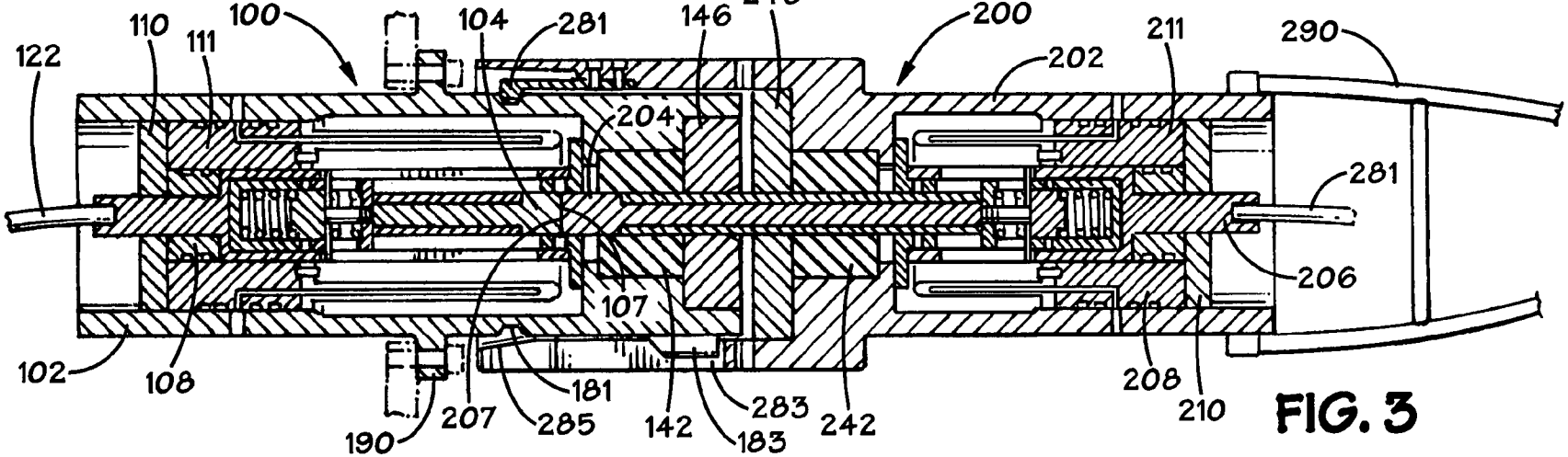

FIGS. 1, 2 and 3 are cross-sectional side views of one illustrative embodiment of a connector 10 in accordance with the present invention in various states of engagement/disengagement. More specifically, FIGS. 1, 2 and 3 depict, respectively, the connector 10 in a fully disengaged state, a transient state (between fully disengaged and fully engaged), and a fully engaged state. In the illustrative embodiment depicted herein, the connector 10 has a single conductive member or pin. However, after a complete reading of the present application, those skilled in the art will readily appreciate that the present invention may be employed in multiple pin applications. Thus, the present invention should not be considered as limited to the specifically disclosed embodiment described herein.

Figure 4A:
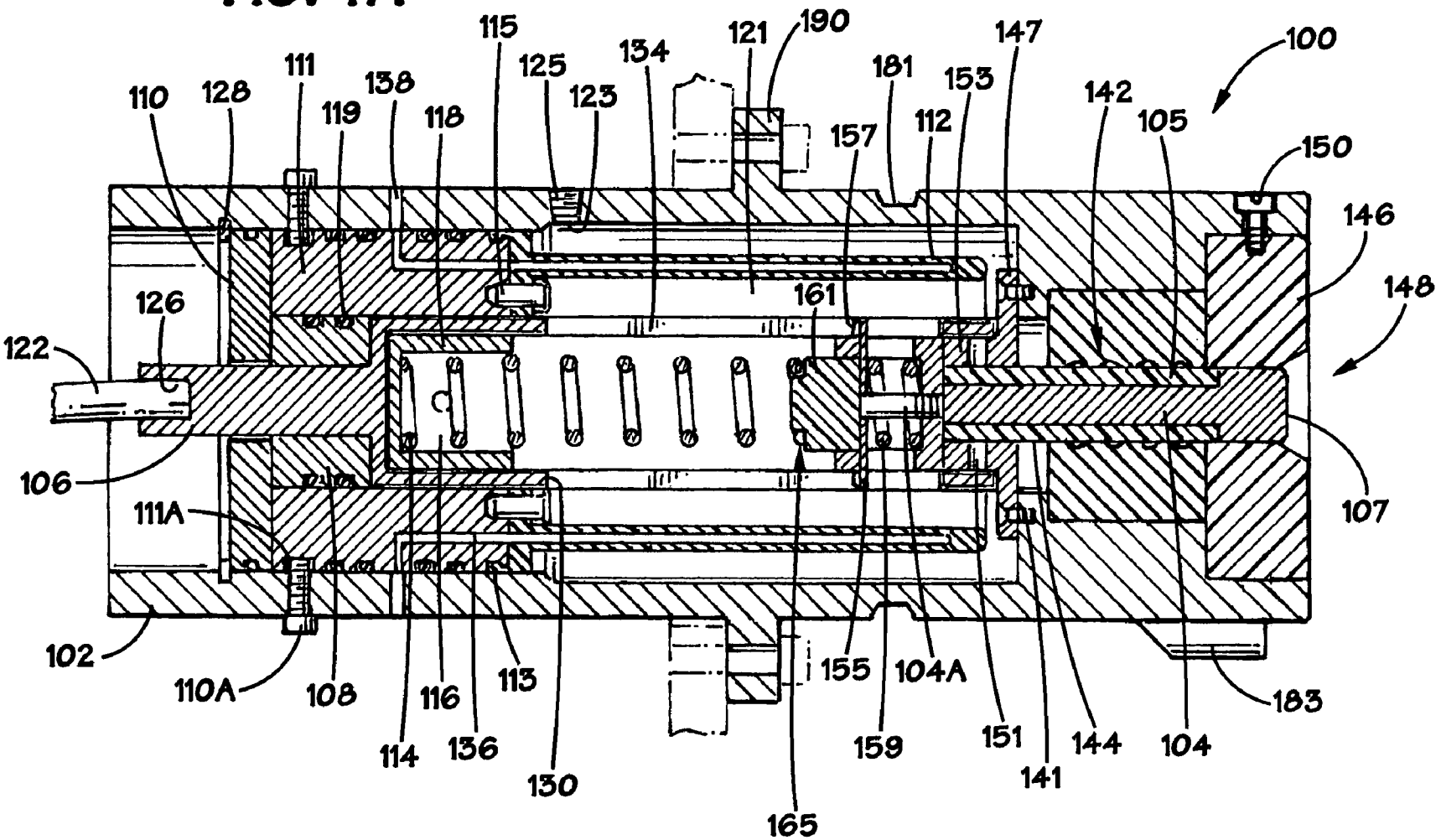
FIGS. 4A–4C are side views of a connector in accordance with one illustrative embodiment of the present invention.
Figure 4B:
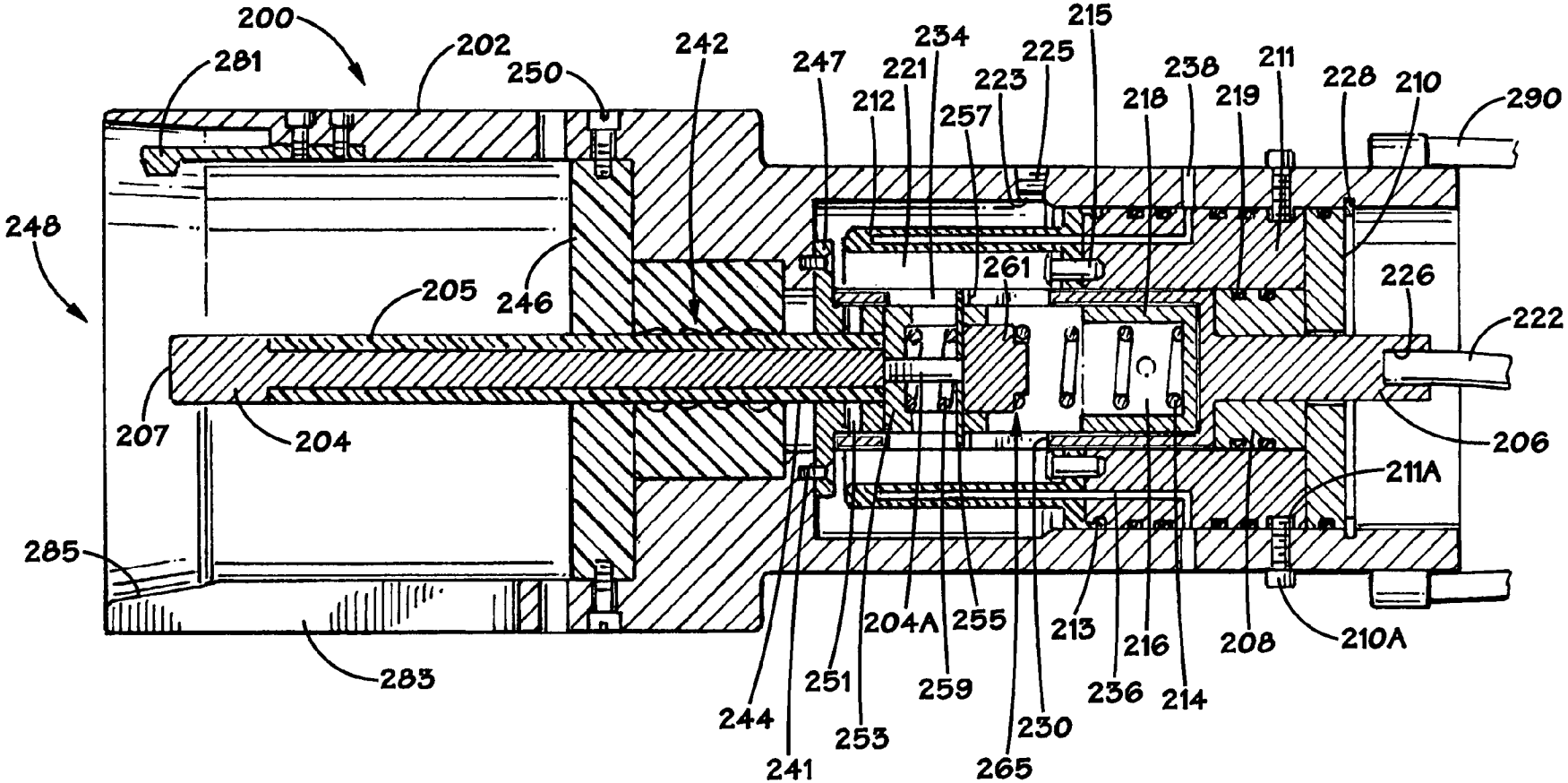
Figure 5:
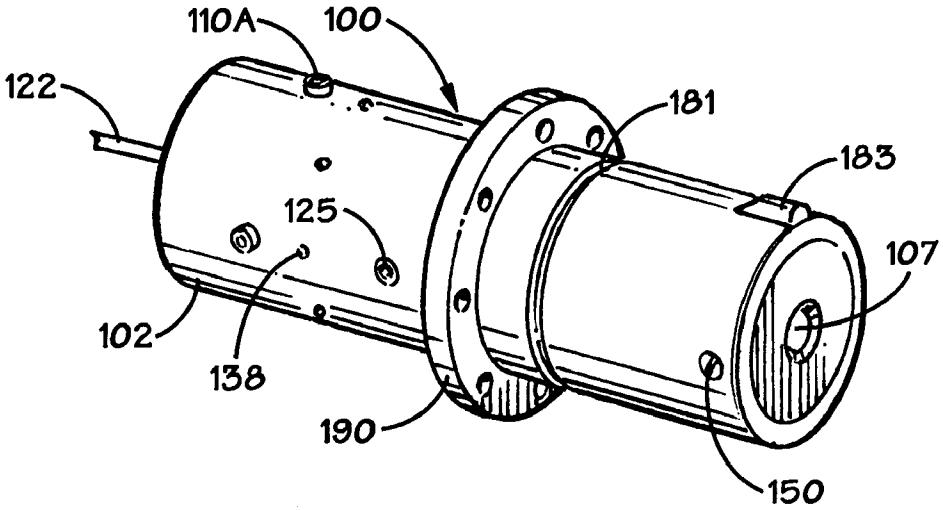
FIG. 5 is a perspective view of one illustrative embodiment of the first connector half of the present invention.
Figure 6:
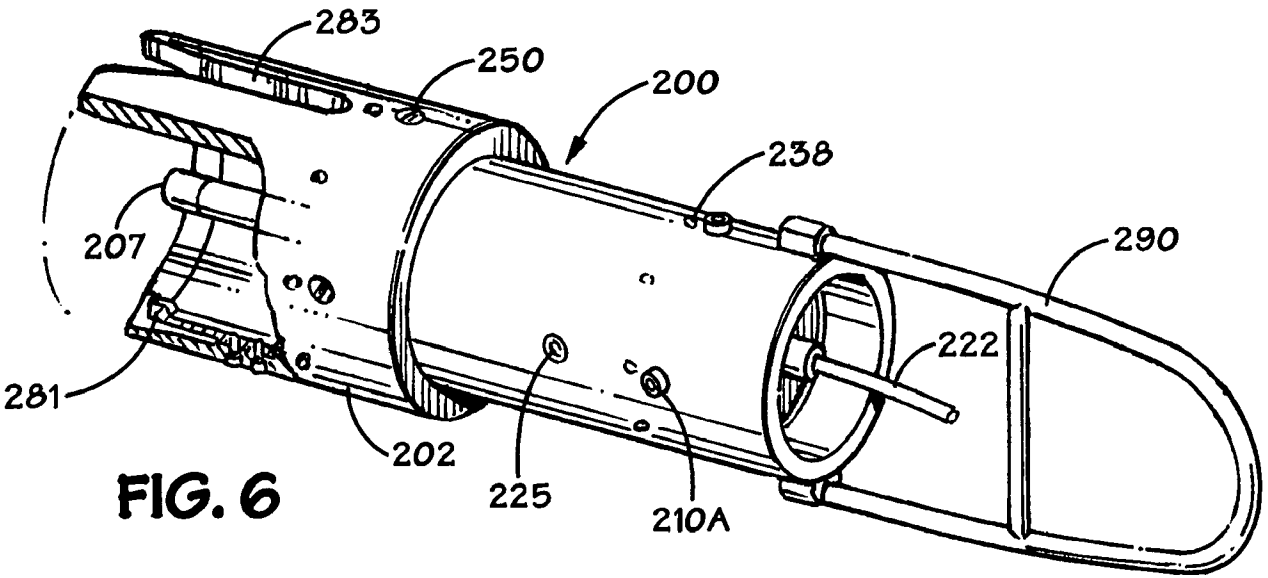
FIG. 6 is a perspective view of one illustrative embodiment of the second connector half of the present invention.

As indicated above, FIG. 1 depicts one illustrative embodiment of the connector 10 in accordance with the present invention. As indicated therein, the illustrative connector 10 is comprised of a first half 100 and a second half 200. FIGS. 4A–4B are enlarged cross-sectional views of the first half 100 and the second half 200, respectively. FIG. 5 is a perspective view of one illustrative embodiment of the first connector half 100. FIG. 6 is a perspective view of one illustrative embodiment of the second connector half 200.

Figure 7:
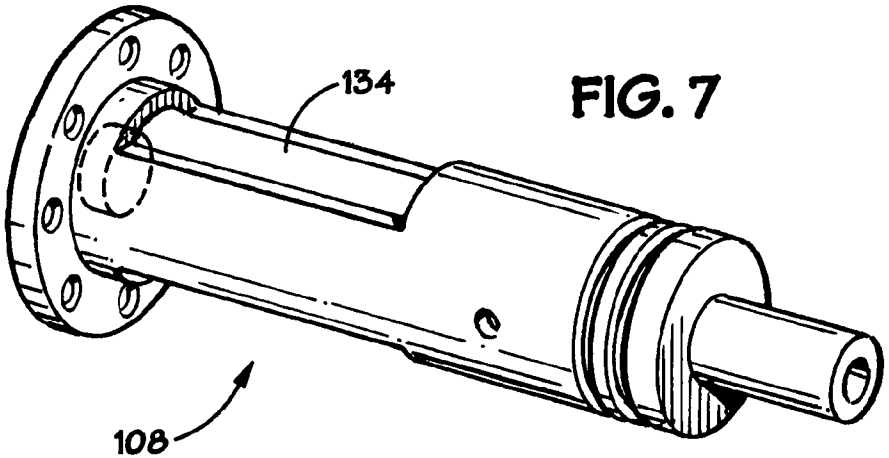
FIG. 7 is a perspective view of an illustrative embodiment of an insulating assembly that may be employed with the present invention.

As depicted in FIG. 4A, the first half 100 comprises a body 102, a movable conductive member 104, a stationary conductive member 106, an insulating assembly 108, a support plate 110, a bladder support member 111, and a bladder 112. A perspective view of one illustrative embodiment of the insulating assembly 108 is depicted in FIG. 7. The first half 100 further comprises a spring 114, a portion of which is positioned in a recess 116. A portion 118 (see FIG. 4C) of the insulating assembly 108 is positioned between the spring 114 and the stationary conductive member 106. The stationary conductive member 106 has a recess or solder pot 126 where an electrical connection can be made to the stationary conductive member 106. As depicted in the drawings, an illustrative electrical wire 122 is coupled to the recess 126. The support plate 110 may be secured in the body 102 by a variety of techniques, e.g., by use of a snap ring 128. The bladder support ring 111 is secured to the body 102 by a plurality of set screws 110A that engage a groove 111A formed in the bladder support ring 111. The stationary conductive member 106 has an exposed end surface 130 through which a conductive flow path may be established, as described more fully below. In one embodiment, the stationary conductive member 106 may be molded within the insulating assembly 108. Portions of the insulating assembly 108 may be removed where it is desirable to establish electrical contact to the stationary conductive member 106, e.g., the end surface 130 and the recess 126.

As indicated in FIG. 7, the insulating assembly 108 comprises a plurality of slots 134 to allow a dielectric fluid to flow therethrough and to allow assembly of the connector 10, as will be described more fully below. The bladder 112 is in fluid communication with the environment external to the body 102 via flow lines 136 formed in the bladder support ring member 111 and openings 138 formed in the body 102. The bladder 112 is secured to the bladder support member 111 by a plurality of threaded fasteners 115, e.g., screws. A plurality of seals 119, e.g., O-rings, are provided between the insulating assembly 108 and the bladder support member 111. Also note that a portion or lip 113 of the bladder 112 is positioned between a portion of the bladder support member 111 and the body 102. A cavity 121 is defined within the body 102. The body 102 further comprises at least one filling port 123 formed in the body 102. The cavity 121 may be filled with a dielectric fluid or oil through the filling port 123. An illustrative threaded fastener 125 is depicted as being positioned in the opening 123.

The first half 100 further comprises a movable conductive member 104 that has an insulating sheath 105 positioned around the conductive member 104 and an end surface 107. The insulating sheath 205 may not be required in all embodiments of the present invention. In the illustrative embodiment depicted in the drawings, the movable conductive member 104 further comprises a non-insulated, reduced diameter section 104A, although this particular configuration may not be employed in all applications. A swiping seal assembly 142 (e.g., a Morrison-type seal) is adapted to engage the exterior surface 144 of the sheath 105 on the movable pin 104. A non-conductive face plate 146 is positioned in the open end 148 of the body 102. The face plate 146 may be secured to the body 102 in any desired manner. In the illustrative embodiment depicted in the drawings, a plurality of threaded fasteners 150 are employed to secure the face plate 146 to the body 102.

In the depicted embodiment, the device further comprises a non-conductive support flange 147 that is coupled to the body 102 by a plurality of threaded fasteners 141. A plurality of openings 151 are provided in the support flange 147 to allow a fluid to flow therethrough, as will be described more fully below. The reduced diameter portion 104A of the movable conductive member 104 extends through and is coupled to an insulated pin guide 153. The reduced diameter portion 104A may be coupled to the insulated pin guide 153 by any desired technique, e.g., threaded, press-fit, pinned connection, etc.

Figure 8:
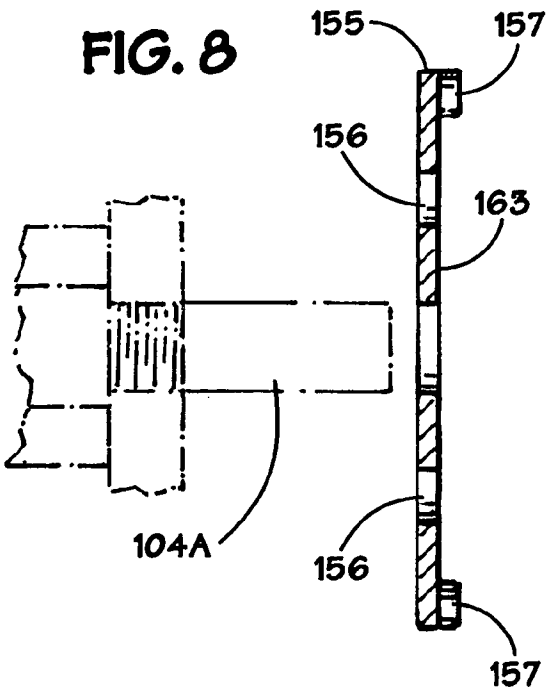
FIG. 8 is a side view of an illustrative conductive plate that may be employed with various embodiments of the present invention.

Ultimately, the movable conductive member 104 will be conductively coupled to the stationary conductive member 106. Such conductive coupling may be established by actual engagement or conductive contact between the members 104, 106 or indirectly through one or more intermediate structures. In the depicted embodiment, the connector half 100 further comprises an intermediate conductive member 155 positioned between the movable conductive member 104 and the stationary conductive member 106. In one illustrative embodiment, a conductive electrical flow path between the movable conductive member 104 and the stationary conductive member 106 will be established through the intermediate conductive member 155. In the illustrative embodiment depicted in the drawings, the intermediate conductive member 155 comprises a conductive plate having a plurality of conductive protrusions 157 extending therefrom. A cross-sectional side view of one illustrative embodiment of the intermediate conductive member 155 is depicted in FIG. 8. The intermediate conductive member 155 may have one or more openings 156 formed therein to allow the flow of dielectric fluid therethrough. The intermediate conductive member 155 may be of any desired shape or configuration, e.g., a disk, and it may have a thickness of approximately 0.125 inches.

As will be described more fully below, in the depicted embodiment, the portion 104A of the movable conductive pin 104 is adapted to conductively contact a portion of the conductive plate 155 to thereby provide a conductive flow path. A spring 159 is provided between the conductive plate 155 and the insulated pin guide 153. An insulated spring retainer 161 engages a surface 163 (see FIG. 8) of the conductive plate 155. One end of the spring 114 engages a stepped profile 165 formed on the spring retainer 161. Ultimately, in the illustrative embodiment described herein, the conductive protrusions 157 of the conductive plate 155 will be urged into conductive contact with the conductive end surface 130 of the stationary conductive member 106 to thereby establish a contact-based conductive flow path therebetween.

The second connector half 200 has, in many respect, a similar construction to that of the first connector half 100. Thus, similar components will be identified with corresponding reference numbers using a prefix of "2" instead of "1." As shown in FIG. 4B, the second half 200 comprises a body 202, a movable conductive member 204, a stationary conductive member 206, an insulating assembly 208, a support plate 210, a bladder support member 211, and a bladder 212. The second half 200 further comprises a spring 214, a portion of which is positioned in a recess 216. A portion 218 of the insulating assembly 208 is positioned between the spring 214 and the stationary conductive member 206. The stationary conductive member 206 has a recess or solder pot 226 where an electrical connection can be made to the stationary conductive member 206. An illustrative electrical wire 222 may be coupled to the recess 226. The support plate 210 may be secured in the body 202 by a snap ring 228. The bladder support ring 211 is secured to the body 202 by a plurality of set screws 210A that engage a groove 211A formed in the bladder support ring 211. The stationary conductive member 206 has an exposed end surface 230 through which a conductive flow path may be established, as described more fully below.

The insulating assembly 208 comprises a plurality of slots 234 to allow a dielectric fluid to flow therethrough and to allow assembly of the connector 10, as will be described more fully below. The bladder 212 is in fluid communication with the environment external to the body 202 via flow lines 236 formed in the bladder support ring member 211 and openings 238 formed in the body 202. The bladder 212 is secured to the bladder support member 211 by a plurality of threaded fasteners 215, e.g., screws. A plurality of seals 219, e.g., O-rings, are provided between the insulating assembly 208 and the bladder support member 211. Also note that a portion or lip 213 of the bladder 212 is positioned between a portion of the bladder support member 211 and the body 202. A cavity 221 is defined within the body 202. The body 202 further comprises at least one filling port 223 formed in the body 202. An illustrative threaded fastener 225 is depicted as being positioned in the opening 223. The cavity 221 may likewise be filled with a dielectric fluid.

The second half 200 further comprises a movable conductive member 204 that has an insulating sheath 205 positioned around the pin 204 and an end surface 207. The insulating sheath 205 may not be required in all embodiments of the present invention. The movable conductive member 204 further comprises a non-insulated, reduced diameter section 204A. A swiping seal assembly 242 (e.g., a Morrison-type seal) is adapted to engage the exterior surface 244 of the sheath 205 on the movable conductive member 204. A non-conductive face plate 246 is positioned in the open end 248 of the body 202. The face plate 246 may be secured to the body 202 in any desired manner. In the illustrative embodiment depicted in the drawings, a plurality of threaded fasteners 250 are employed to secure the face plate 246 to the body 202.

In the depicted embodiment, the device further comprises a non-conductive support flange 247 that is coupled to the body 202 by a plurality of threaded fasteners 241. A plurality of openings 251 are provided in the support flange 247 to allow a fluid to flow therethrough, as will be described more fully below. The reduced diameter portion 204A of the movable conductive member 204 extends through and is coupled to an insulated pin guide 253. The reduced diameter portion 204A may be coupled to the insulated pin guide 253 by any desired technique, e.g., threaded, press-fit, pinned connection, etc.

Ultimately, the movable conductive member 204 will be conductively coupled to the stationary conductive member 206. Such conductive coupling may be established by actual engagement or conductive contact between the members 204, 206 or indirectly through one or more intermediate structures. In the depicted embodiment, the connector half 200 further comprises an intermediate conductive member 255 having a plurality of conductive protrusions 257 extending therefrom. The conductive plate 255 may have one or more openings formed therein to allow the flow of fluid therethrough.

As will be described more fully below, the portion 204A of the movable conductive member 204 is adapted to engage a portion of the conductive plate 255 to thereby provide a conductive flow path. A spring 259 is provided between the conductive plate 255 and the insulated pin guide 253. An insulated spring retainer 261 of the insulating assembly 208 engages a surface 263 of the conductive plate 255. One end of the spring 214 engages a stepped profile 265 formed on the spring retainer 261. Ultimately, in the illustrated embodiment, the conductive protrusions 257 of the conductive plate 255 will be urged into conductive contact with the conductive surface 230 of the stationary conductive member 206 to thereby establish a contact-based conductive flow path therebetween.

Figure 9:
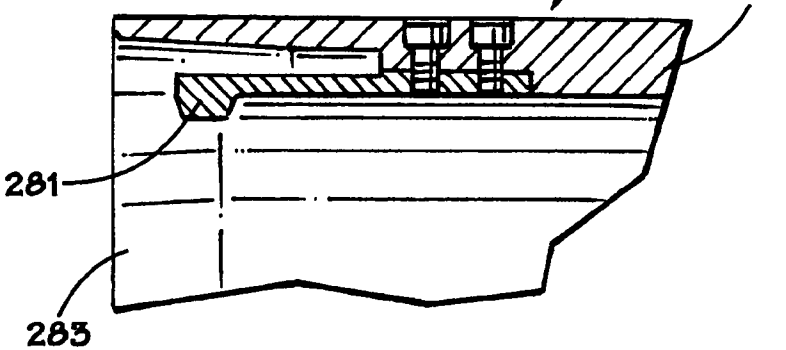
FIG. 9 is a sectional view of an illustrative latching mechanism that may be employed with various embodiments of the present invention.

FIG. 9 is a depiction of an illustrative latching mechanism that may be employed with the present invention. In one embodiment, as depicted in FIGS. 5 and 9, an external groove 181 is formed in the body 102, and a spring-type latch 281 is provided on the interior of the body 202. When the connector halves 100, 200 are fully mated together, the spring latch 281 engages the groove 181 to insure that the connector halves remain mated together. Radial alignment of the connector halves 100, 200 may be assisted by the presence of an alignment slot 283 formed in the body 202 of the connector half 200 that is adapted to aligningly engage with an alignment protrusion 183 attached to the body 102 of the connector half 100 (see FIGS. 5 and 6). The alignment slot 283 and protrusion 183 may be of any desired shape, configuration and construction, and a plurality of such alignment slots and protrusions may be provided if desired. The body 202 is provided with a tapered surface 285 (see FIG. 4B) to assist with aligning the two connector halves 100, 200 when they are in the process of engaging one another. An ROV (remote operated vehicle) handle 290 (see FIG. 6) is coupled to the body 202 such that the mating/unmating of the connector halves 100, 200 may be accomplished using an ROV. In some applications, an illustrative flange 190 (see FIG. 5) may be coupled to one or more of the connector halves 100, 200. For example, the flange 190 may allow the connector half 100 to be threadingly coupled, e.g., bolted, to a subsea component, e.g., a Christmas tree, a blowout preventer, subsea distribution hardware, a valve, an instrument panel, a control module, etc. Alternatively, the body 102 may be welded to a subsea component. The present connector may also be employed in surface applications, such as, for example, a surface application that requires connectors having intrinsically safe mating and unmating characteristics.

Figure 4C:
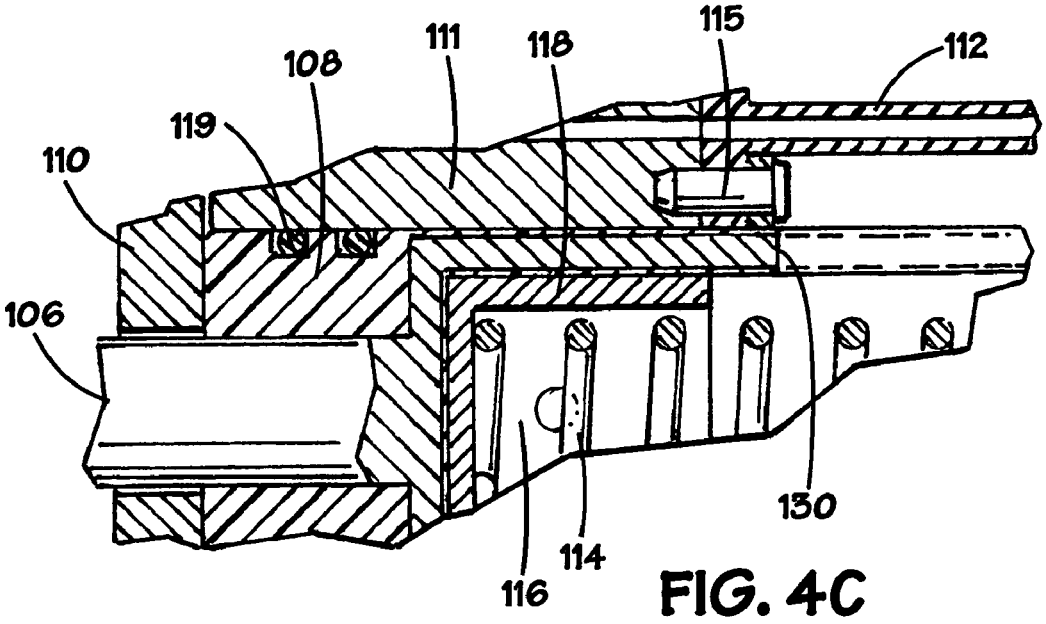

In the illustrative embodiment of the connector 10 depicted in FIGS. 4A–4C, the end surfaces 107, 207 of the movable conductive members 104, 204, respectively, are adapted to conductively contact one another to provide a contact-based conductive flow path therebetween. The size, shape and configuration of the engaging portions or surfaces 107, 207 of the movable conductive members 104, 204 may vary depending upon the particular application. Moreover, the movable conductive members 104, 204 may or may not be provided with a conductive sheath 105, 205 for all or a portion of the axial length of the movable conductive members 104, 204. As will be recognized by those skilled in the art after a complete reading of the present application, the size and configuration of the movable conductive members 104, 204, as well as the stationary conductive members 106, 206, and the intermediate members 255 (if employed at all), may vary depending upon the particular application.

Figure 10A:
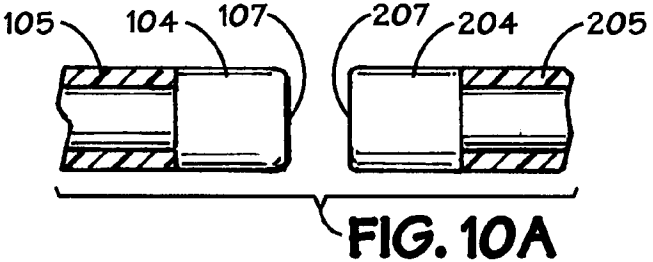
FIGS. 10A–10G depict various illustrative configurations of means by which the ends of the movable conductive members described herein may engage one another.
Figure 10B:
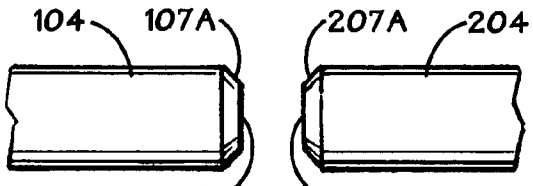
Figure 10C:
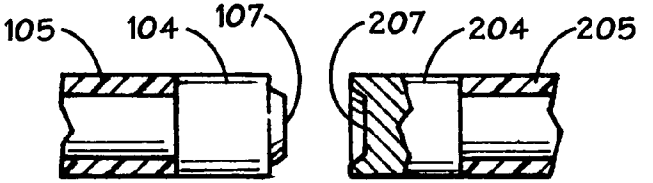
Figure 10D:
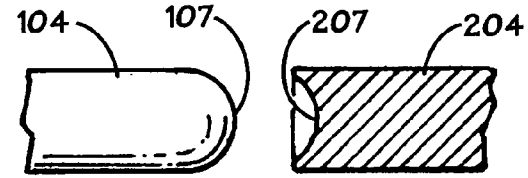
Figure 10E:
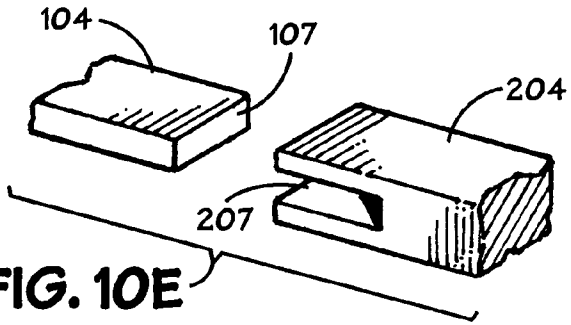
Figure 10F:
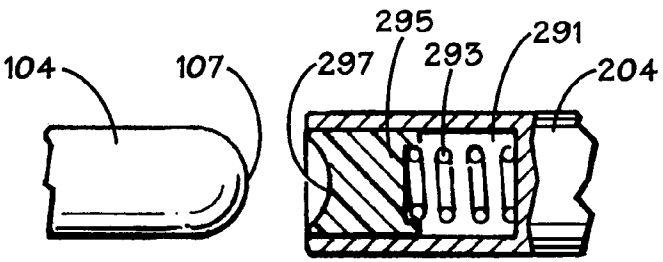
Figure 10G:
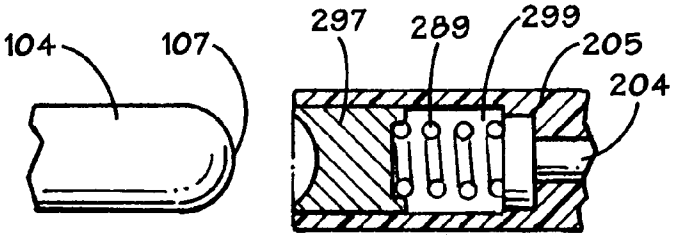

FIGS. 10A–10G depict various illustrative alternates for the end configurations 107, 207. For example, as indicated in FIG. 10A, the end surfaces 107, 207 are substantially planar. In FIG. 10B, the movable conductive members 104, 204 are substantially solid pieces of conductive material that do not have an insulating sheath positioned therearound. The members 104, 204 depicted therein have tapered or chamfered corners 107A, 207A. In the embodiment depicted in FIG. 10C, the end surface 207 is in the form of a recess while the end surface 107 has a slight protruding area. The interaction between the surfaces 107, 207 of the embodiment depicted in FIG. 10C may tend to assist in maintaining axial alignment between the movable conductive members 104, 204 during mating operations. FIG. 10D depicts an illustrative example where the end surface 107 is substantially rounded and the end surface 207 is a substantially spherical or rounded recess. FIG. 10E depicts an illustrative example of a tongue-and-groove type configuration wherein the end surface 207 has a groove formed therein. FIG. 10F depicts an illustrative example wherein the end surface 207 is provided with a recess 291 formed therein. A spring 293 is positioned behind an insulating member 295 having a rounded surface 297 formed therein. The end surface 107 of the movable conductive member 104 engages the rounded surface 297 of the insulating member 295. As the spring 293 is compressed, conductive contact is established between the movable conductive member 104 and a portion of the movable conductive member 204. FIG. 10G depicts yet another embodiment where the movable conductive member 104 is provided with a substantially rounded or spherical end surface 107. The movable conductive member 204 has a non-conductive sheath 205 that defines a recess 299. A conductive spring 289 and a conductive member 297 are positioned in the recess 299. The end surface 107 is adapted to engage the conductive member 297 to thereby provide a contact-based conductive flow path between the member 104, the member 297, the spring 289 and the member 204.

As will be recognized by those skilled in the art after a complete reading of the present application, the conductive coupling between the movable conductive member, e.g., member 204, and the stationary conductive member, e.g., member 206, may be accomplished using a variety of techniques, and it may involve direct engagement or conductive contact between the members 204, 206 or indirect coupling, e.g., through one or more intermediate conductive members. The same statements apply with respect to the members 104, 106. In some cases, there may be conductive contact between all of the various conductive members in each electrical connector half 100 to establish a contact-based electrical flow path through the connector halves 100, 200. Additionally, the conductive coupling between the end surfaces 107, 207 of the movable members 104, 204 may involve direct conductive contact between the members or an indirect coupling of the end surfaces 107, 207.

For example, in the depicted embodiment, the conductive path is established between the movable conductive member 204 and the stationary conductive member 206 through use of the conductive plate 255 and conductive protrusions 257. FIGS. 11A–11E present other illustrative alternative arrangements for providing such a conductive connection. These illustrative alternatives will be discussed with reference to the movable conductive member 204, although they may be implemented in both connector halves 100, 200.

Figure 11A:
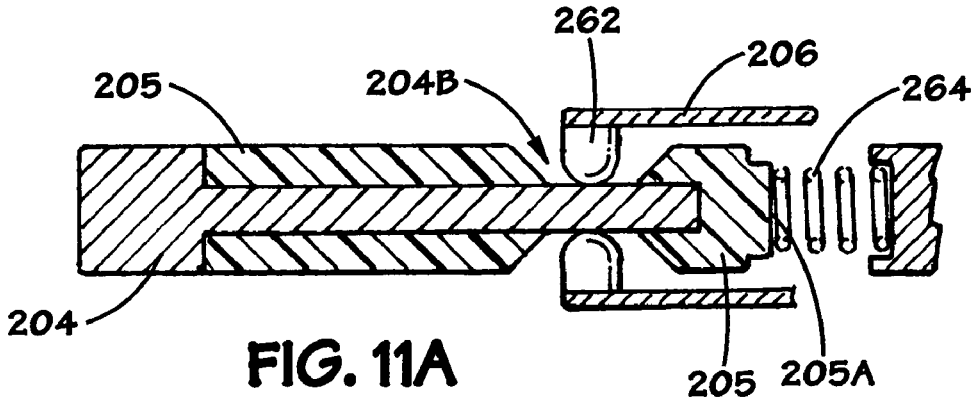
FIGS. 11A–11E depict various illustrative configurations whereby a conductive flow path may be provided between the movable conductive member and the stationary conductive member employed in the illustrative embodiment of the connector depicted herein.
Figure 11B:
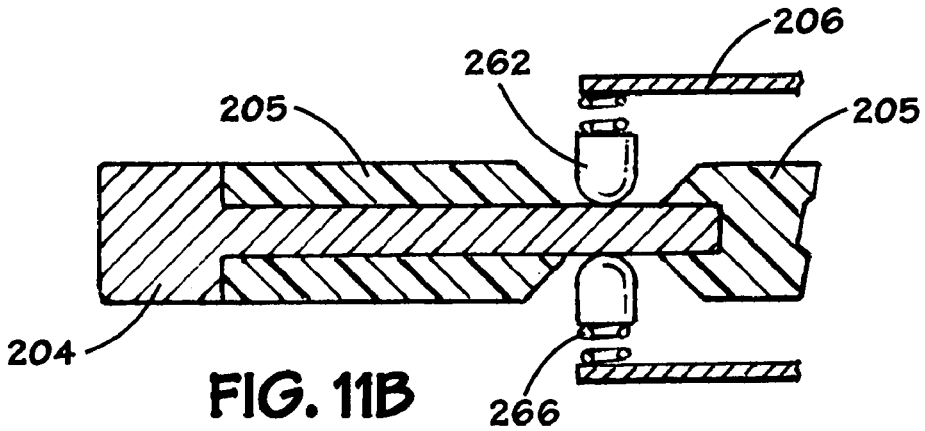

FIG. 11A depicts an illustrative embodiment wherein the stationary conductive member 206 is provided with conductive protrusions 262 that are adapted to engage an exposed portion 204B of the movable conductive member 204. The stationary member 206 and/or conductive protrusion 262 are designed with a sufficient degree of flexibility or compliance such that the movable conductive member 204 may be moved from the engaged, conductive position shown in FIG. 11A to a disengaged position (not shown) when the connector halves 100, 200 are mated/unmated. A schematically depicted spring 264 may be provided to engage an end surface 205A if desired. FIG. 11B depicts yet another illustrative embodiment wherein a plurality of conductive protrusions 262 are coupled to the stationary conductive member 206 by a conductive spring 266.

Figure 11C:
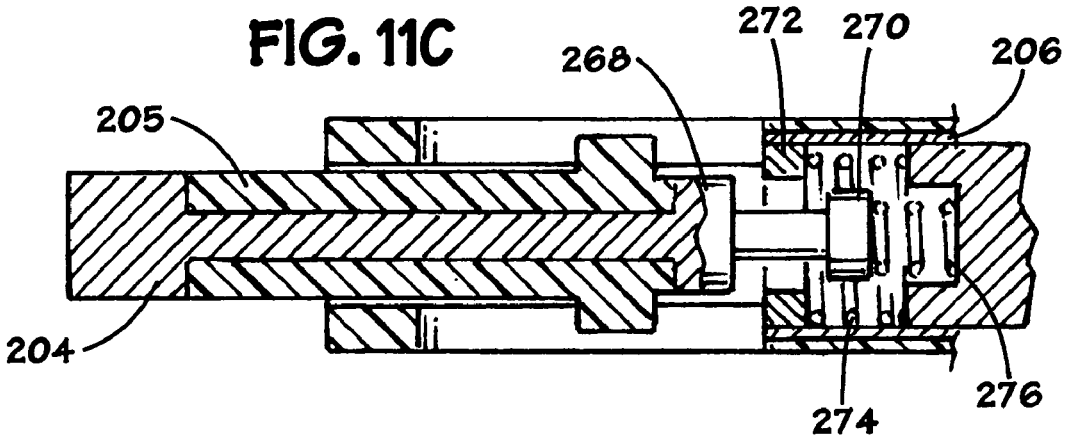

FIG. 11C depicts yet another alternative embodiment where the movable conductive member 204 is provided with a stepped configuration comprised of a first section 268 and a smaller second section 270. A conductive member 272 is positioned adjacent a portion of the stationary conductive member 206. A first spring 274 is adapted to engage the conductive member 272 while a second spring 276 is adapted to engage the section 270 of the conductive member 204. The springs 274, 276 provide a "soft landing" for the various components when the connector halves 100, 200 are mated together.

Figure 11D:
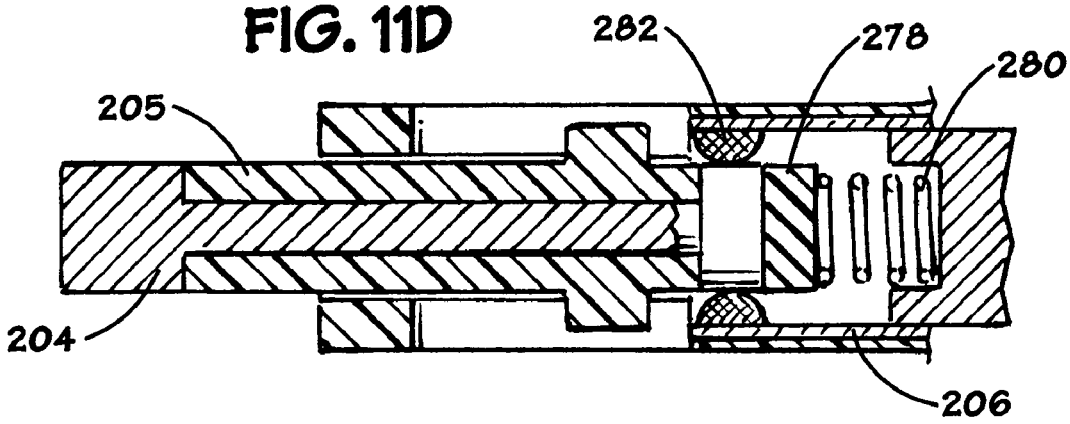
Figure 11E:
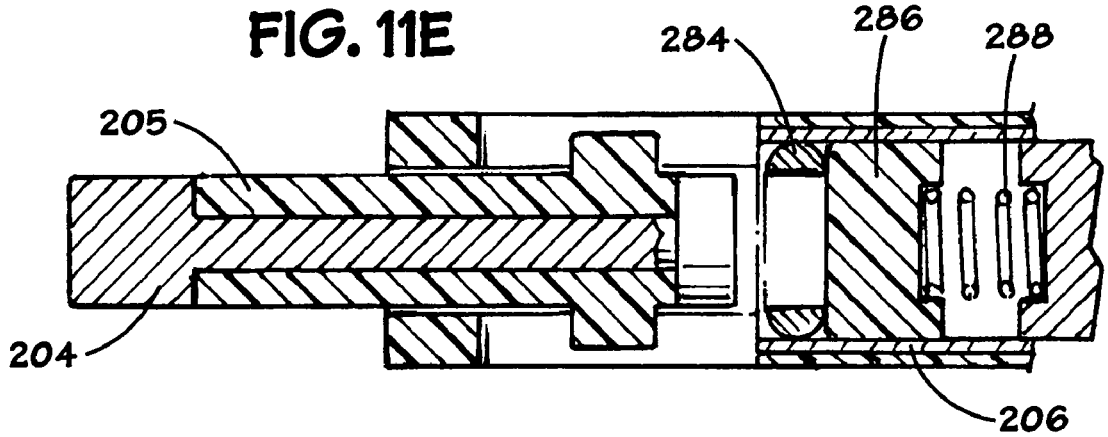

In FIG. 11D, an insulating member 278 and spring 280 are provided to engage the end surface of the conductive member 204. A plurality of conductive protrusions 282 are conductively coupled to the stationary conductive member 206, and they are adapted to engage the conductive member 204. The conductive protrusions 282 may be a conductive mesh or a solid conductive material. As with other embodiments, the various components are designed such that the conductive member 204 may be positioned in the conductive, mated state shown in FIG. 11D or in a non-conductive, disengaged state (not shown). In FIG. 11E, a conductive ring or member 284 is provided that is adapted to engage a portion of the stationary conductive member 206. An insulating member 286 and spring 288 are provided to engage the conductive member 284. In the embodiment depicted in FIG. 11E, the conductive member 284 may be in continuous conductive contact with the stationary conductive member 206 or it may be axially moved within the stationary conductive member 206 to a point wherein it conductively engages a portion of the stationary conductive member 206.

Figure 12A:
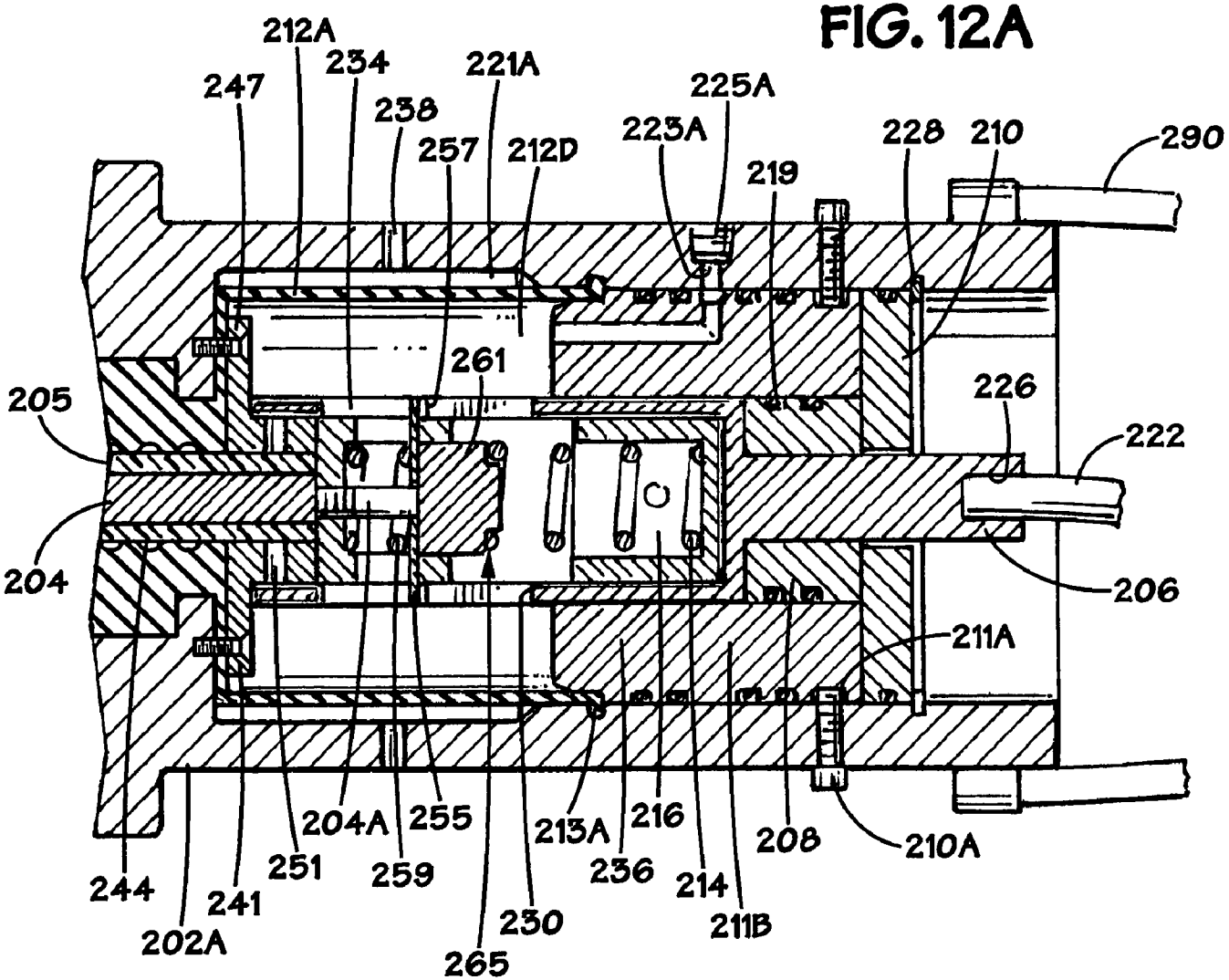
FIGS. 12A–12B depict alternative embodiments of the connector described herein wherein an integrated bladder is employed.
Figure 12B:
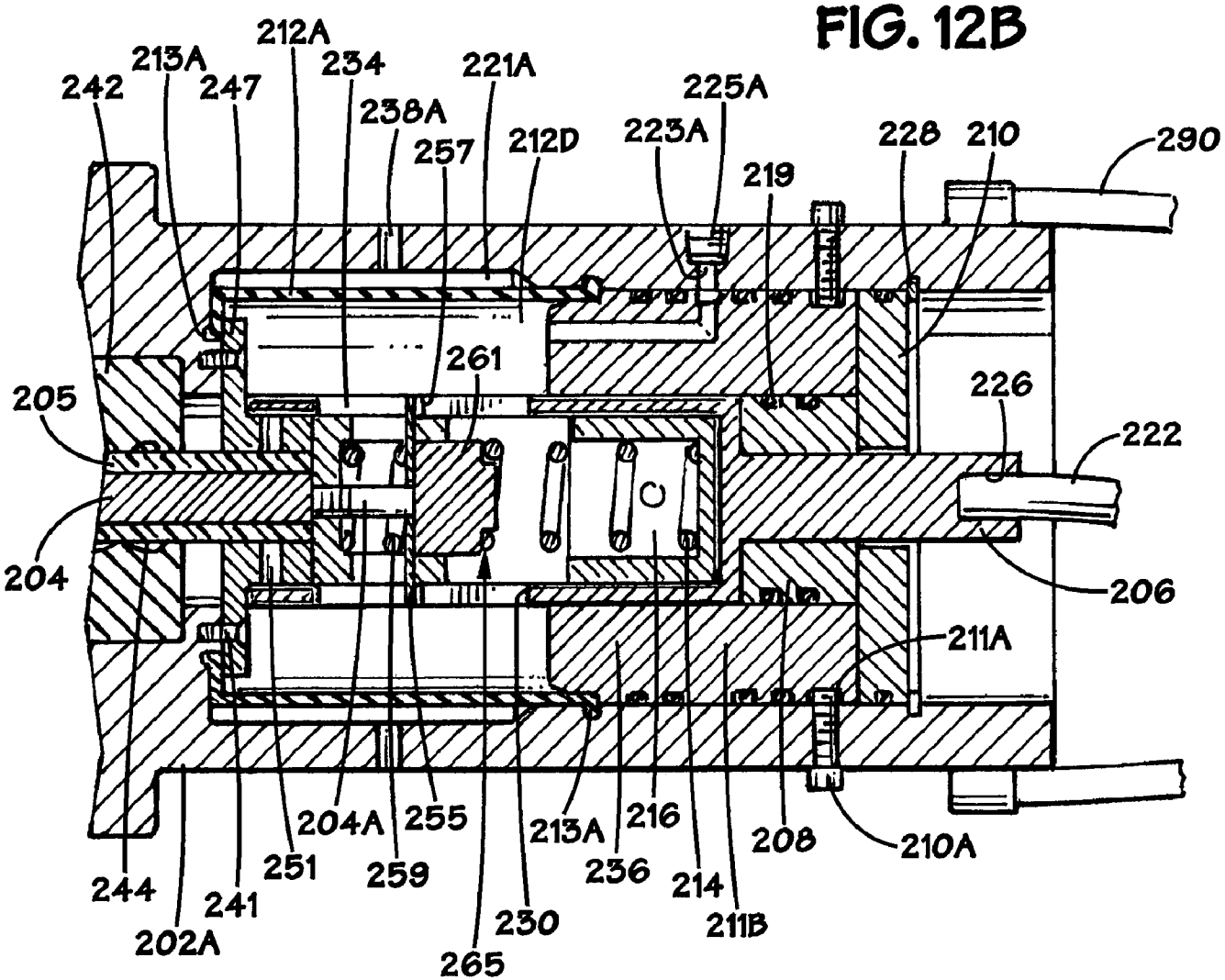

FIGS. 12A–12B schematically depict illustrative embodiments of the present invention wherein an integral bladder may be provided with each half 100, 200 of the connector 10. For convenience, only the illustrative second connector half 200 is depicted with the illustrative integral bladder 212A. However, such a configuration may also be implemented in the first connector half 100 as well. In contrast to the bladder 112 depicted in FIGS. 4A–4B, the bladder 212A depicted in FIG. 12A is of such a design as to completely envelope the internal components of the connector half 200. The bladder 212A defines an interior region 212D that will be filled with a dielectric fluid or oil. That is, the bladder 212A depicted in FIG. 12A is a single component that is coupled to the body 202 by the bladder support member 211B, and it extends behind the flange 247 and engages the exterior surface 244 of the sheath 205 around the conductive member 204.

FIG. 12B depicts an embodiment wherein a bladder 212A encapsulates many internal components of the connector half 200. In this embodiment, the bladder 212A only extends to a point behind the flange 247. A portion of the bladder 212A is positioned in a recess 213A formed in the body 202 and retained therein by the flange 247.

In the various embodiments depicted herein, the connector halves 100, 200 may have a dielectric fluid introduced therein. For example, in the embodiment depicted in FIGS. 4A–4B, the cavities 121, 221 may be filled with a dielectric fluid introduced through the fill port 123. When the illustrative embodiment of the connector depicted in FIGS. 4A–4B is positioned in a subsea environment, water will fill the bladder 112 via the opening 138 and the flow passages 136, thereby insuring that there is very little, if any, differential pressure across the bodies 102, 202 of the connector 10. In the embodiment depicted in FIGS. 12A–12B, the bladder 212A may be filled with a dielectric fluid prior to positioning the connector 10 in a subsea environment. Water is allowed to enter the bodies 102, 202 via openings 238 to thereby insure that there is no differential pressure acting on the bodies 102, 202 or the various components of the connector 10.

One illustrative mating sequence for the connector 10 will now be described with reference to FIGS. 1–3. Ultimately, conductive contact between the end 107 of the movable conductive member 104 and the end 207 of the movable conductive member 204 will provide an electrically conductive flow path that allows electricity to flow through the connector 10. In FIG. 1, the connector halves 100, 200 are shown in completely disengaged positions. Note that, in the illustrative embodiment of the connector 10 depicted in FIG. 1, the conductive protrusions 157 of the conductive plate 155 are not engaged with the end surface 130 of the stationary conductive member 106. Similarly, the conductive protrusions 257 of the conductive plate 255 are not engaged with the end surface 230 of the stationary conductive member 206.

FIG. 2 depicts the connector 10 in a transient position intermediate of the fully disengaged position shown in FIG. 1 and the fully engaged position in FIG. 3. As shown in FIG. 2, the end 207 of the movable conductive member 204 has engaged the end 107 of the movable conductive member 104 thereby causing the movable conductive member 104 to move axially with the body 102 (to the left in FIG. 2). The movable conductive member 104 moves before the movable conductive member 204 because the spring 114 is designed to provide less spring force than the spring 214. For example, the spring 114 may have a smaller spring constant than that of the spring 214. Of course, if desired, the relative spring forces could be reversed such that the movable conductive member 204 moves before the movable conductive member 104.

One illustrative sequence of events will now be described reflecting the interaction between various components of the connector halves 100, 200. However, it should be understood that such a mating sequence is provided by way of example only, as the relative movement of the various components and the sequence of movement of such components can be readily varied by the design of the connector, if desired. As the connector halves 100, 200 are mated together, any water within the connector 10 is discharged through the openings in the bodies 102, 202, respectively. The connection sequence is continued until the conductive portion 104A of the movable conductive member 104 engages the conductive plate 155. The mating process is continued until the conductive protrusions 157 engage the end surface 130 of the stationary conductive member 106. Continued mating of the connector halves 100, 200 causes the portion 204A of the movable conductive member 204 to engage the conductive plate 155. Further mating causes the conductive protrusions 257 to engage the end surface 230 of the stationary conductive member 206. Depending upon how the springs 114, 214 are designed and sized, the movable conductive member 204 may begin axially moving within the body 202 (to the right in FIG. 3) before the conductive protrusions 157 actually engage the end surface 130 of the stationary conductive member 106.

Radial alignment of the connector halves 100, 200 may be accomplished by virtue of an alignment slot 283 formed in the body 202 of the second connector half 200 and an alignment protrusion 183 formed on the body 102 of the first connector half 100. The connector halves 100, 200 may be decoupled or coupled using a variety of known techniques or devices. For example, in the depicted embodiment, the connector half 200 is provided an ROV (remote operated vehicle) handle 290 (see FIG. 6) such that any of a variety of well known ROVs may be employed to couple/decouple the connector 10. The connector 10 may also be mated/unmated by a subsea diver.

As will be recognized by those skilled in the art after a complete reading of the present application, the present invention has broad applicability and may be implemented in a variety of forms. For example, as mentioned previously, although the present invention has been disclosed with reference to a single conductive pin embodiment, those skilled in the art will recognize that the present invention may be employed with connectors having multiple conductive pins therein. Moreover, the physical size and configuration of the connector halves 100, 200 may vary depending upon the particular application. In the depicted embodiment, the connector bodies 102, 202 have a generally cylindrical configuration having an outside diameter of approximately 1.5–2.0 inches. The bodies 102, 202 may be made of any desired material, e.g., stainless steel. The wall thickness of the bodies 102, 202 may vary depending upon the application. For example, in one illustrative embodiment, the wall thickness may be approximately 0.125–0.5 inches with an axial length of about 4.0–5.5 inches. The various conductive members 104, 106, 155, 157, 204, 206, 255, 257 may be made of a variety of conductive materials, e.g., silver-cadmium, beryllium-copper, etc. The various insulating members 108, 111, 146, 147, 153, 161, 208, 211, 246, 247, 253, 261 may be made of a variety of insulating materials, e.g., plastic, rubber, elastomer, etc.

The present invention is directed to various embodiments of a connector. In one illustrative embodiment, the connector comprises a first connector half and a second connector half adapted to be coupled to a power supply source, wherein the first and second connector halves are adapted to, when coupled to one another, define at least one electrical conductive path through the first and second connector halves by contact between at least one conductive member in each of the first and second connector halves, and wherein the first and second connector halves are adapted to be mated or unmated while power is being supplied to at least the second connector half.

In another illustrative embodiment, the connector comprises a first connector half adapted to be coupled to a subsea component, a second connector half adapted to be coupled to the first connector half and means for establishing a contact-based electrical conductive path through the first and second connector halves such that the first and second connector halves may be mated or unmated while electrical power is supplied to at least one of the first and second connector halves.

In yet another illustrative embodiment, the connector comprises a first connector half adapted to be coupled to a subsea component and a second connector half adapted to be coupled to the first connector half, each of the first and second connector halves comprising a body, a stationary conductive member positioned in the body and a movable conductive member positioned in the body, the movable conductive member being adapted to be conductively coupled to the stationary conductive member.

In a further illustrative embodiment, the connector comprises a first connector half adapted to be coupled to a subsea component and a second connector half adapted to be coupled to the first connector half, each of the first and second connector halves comprising a body, a stationary conductive member positioned in the body, a movable conductive member positioned in the body and an intermediate conductive member positioned between the stationary conductive member and the movable conductive member, wherein at least one of the stationary conductive member and the movable conductive member conductively contacts the intermediate conductive member.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A connector, comprising:

a first connector half; and a second connector half adapted to be coupled to a power supply source, wherein said first and second connector halves are adapted to, when coupled to one another, define at least one electrical conductive path through said first and second connector halves by contact between at least one conductive member in each of said first and second connector halves, and wherein said first and second connector halves are adapted to be mated or unmated while power is being supplied to at least said second connector half, wherein each of said first and second connector halves comprises:

a body;

a bladder positioned within said body, wherein said bladder is adapted to be filled with a fluid;

a stationary conductive member; and a movable conductive member that is adapted to be conductively coupled to said stationary conductive member.

2. The connector of claim 1, wherein said fluid is a fluid from an environment surrounding said body.

3. The connector of claim 1, wherein said fluid is a dielectric fluid.

4. The connector of claim 1, wherein said first connector half comprises a flange adapted for mounting said first connector half to a subsea component.

5. The connector of claim 1, wherein said second connector half comprises a handle adapted to be grasped by a remote operating vehicle.

6. The connector of claim 1, wherein said connector further comprises:

at least one radial alignment slot formed in at least one of said first and second connector halves; and at least one alignment protrusion formed in at least one of said first and second connector halves, said alignment protrusion adapted to engage said alignment slot.

7. The connector of claim 1, wherein said first connector half is adapted to be operatively coupled to a subsea component.

8. The connector of claim 7, wherein said subsea component comprises at least one of a Christmas tree, a blowout preventer, a valve and an instrument panel.

9. The connector of claim 1, wherein each of said first and second connector halves comprises an intermediate conductive member positioned between said movable conductive member and said stationary conductive member, whereby a conductive flow path between said movable conductive member and said stationary conductive member is established through said intermediate conductive member.

10. The connector of claim 9, wherein each of said stationary conductive member and said movable conductive member conductively contact said intermediate conductive member.

11. The connector of claim 1, wherein, when said first and second connector halves are mated together, an end surface of said movable conductive member in said first connector half conductively contacts an end surface of said movable conductive member in said second connector half.

12. The connector of claim 11, wherein said end surfaces of said movable conductive members buttingly engage one another.

13. The connector of claim 11, wherein one of said end surfaces of said movable conductive members has a recess formed therein, and at least a portion of said end surface of the other of said movable conductive members is adapted to be positioned in said recess.

14. A connector, comprising:

a first connector half adapted to be coupled to a subsea component;

a second connector half adapted to be coupled to said first connector half, wherein each of said first and second connector halves comprises:

a body; and a bladder positioned within said body, wherein said bladder is adapted to be filled with a fluid; and means for establishing a contact-based electrical conductive path through said first and second connector halves such that said first and second connector halves may be mated or unmated while electrical power is supplied to at least one of said first and second connector halves, wherein said means for establishing said contact-based electrical conductive path comprises a stationary conductive member and a movable conductive member positioned in each of said first and second connector halves, wherein said movable conductive members are adapted to conductively contact one another.

15. The connector of claim 14, wherein said movable conductive member in said first connector half is adapted to be conductively coupled to said stationary conductive member in said first connector half, and said movable conductive member in said second connector half is adapted to be conductively coupled to said stationary conductive member in said second connector half.

16. The connector of claim 14, wherein said movable conductive member in said first connector half is adapted to conductively contact said stationary conductive member in said first connector half, and said movable conductive member in said second connector half is adapted to conductively contact said stationary conductive member in said second connector half.

17. The connector of claim 14, wherein said first connector half is adapted to be operatively coupled to a subsea component.

18. The connector of claim 14, wherein said fluid is a fluid from an environment surrounding said body.

19. The connector of claim 14, wherein said fluid is a dielectric fluid.

20. The connector of claim 14, wherein said first connector half comprises a flange adapted for mounting said first connector half to a subsea component.

21. The connector of claim 14, wherein said second connector half comprises a handle adapted to be grasped by a remote operating vehicle.

22. The connector of claim 14, wherein said connector further comprises:

at least one radial alignment slot formed in at least one of said first and second connector halves; and at least one alignment protrusion formed in at least one of said first and second connector halves, said alignment protrusion adapted to engage said alignment slot.

23. The connector of claim 14, wherein said means for establishing said contact-based electrical conductive path further comprises an intermediate conductive member positioned in each of said connector halves between said movable conductive member and said stationary conductive member, whereby a conductive flow path between said movable conductive member and said stationary conductive member is established through said intermediate conductive member.

24. The connector of claim 23, wherein each of said stationary conductive member and said movable conductive member conductively contact said intermediate conductive member.

25. The connector of claim 14, wherein, when said first and second connector halves are engaged, an end surface of said movable conductive member in said first connector half conductively contacts an end surface of said movable conductive member in said second connector half.

26. The connector of claim 25, wherein said end surfaces of said movable conductive members buttingly engage one another.

27. The connector of claim 25, wherein one of said end surfaces of said movable conductive members has a recess formed therein, and at least a portion of said end surface of the other of said movable conductive members is adapted to be positioned in said recess.

28. A connector, comprising:

a first connector half adapted to be coupled to a subsea component; and a second connector half adapted to be coupled to said first connector half, each of said first and second connector halves comprising:

a body;

a bladder positioned within said body, wherein said body is adapted to be filled with a fluid;

a stationary conductive member positioned in said body; and a movable conductive member positioned in said body, said movable conductive member being adapted to be conductively coupled to said stationary conductive member.

29. The connector of claim 28, wherein, when movable conductive member is adapted to conductively contact said stationary conductive member.

30. The connector of claim 28, wherein said first connector half is adapted to be operatively coupled to a subsea component.

31. The connector of claim 28, wherein said fluid is a fluid from an environment surrounding said body.

32. The connector of claim 28, wherein said fluid is a dielectric fluid.

33. The connector of claim 28, wherein said first connector half comprises a flange adapted for mounting said first connector half to a subsea component.

34. The connector of claim 28, wherein said second connector half comprises a handle adapted to be grasped by a remote operating vehicle.

35. The connector of claim 28, wherein said connector further comprises:

at least one radial alignment slot formed in at least one of said first and second connector halves; and at least one alignment protrusion formed in at least one of said first and second connector halves, said alignment protrusion adapted to engage said alignment slot.

36. The connector of claim 28, wherein each of said first and second connector halves comprises an intermediate conductive member positioned between said movable conductive member and said stationary conductive member, whereby a conductive flow path between said movable conductive member and said stationary conductive member is established through said intermediate conductive member.

37. The connector of claim 36, wherein each of said stationary conductive member and said movable conductive member conductively contact said intermediate conductive member.

38. The connector of claim 28, wherein, when said first and second connector halves are engaged, an end surface of said movable conductive member in said first connector half conductively contacts an end surface of said movable conductive member in said second connector half.

39. The connector of claim 38, wherein said end surfaces of said movable conductive members buttingly engage one another.

40. The connector of claim 38, wherein one of said end surfaces of said movable conductive members has a recess formed therein, and at least a portion of said end surface of the other of said movable conductive members is adapted to be positioned in said recess.

41. A connector, comprising:

a first connector half;

a second connector half adapted to be coupled to a power supply source, wherein said first and second connector halves are adapted to, when coupled to one another, define at least one electrical conductive path through said first and second connector halves by contact between at least one conductive member in each of said first and second connector halves, and wherein said first and second connector halves are adapted to be mated or unmated while power is being supplied to at least said second connector half, wherein each of said first and second connector halves comprises:

a body;

a bladder positioned within said body, wherein said bladder is adapted to be filled with a fluid; and a stationary conductive member in each of said first and second halves; and at least one movable conductive member in one of said first and second halves.

42. A connector, comprising:

a first connector half; and a second connector half adapted to be coupled to a power supply source, wherein said first and second connector halves are adapted to, when coupled to one another, define at least one electrical conductive path through said first and second connector halves by contact between at least one conductive member in each of said first and second connector halves, and wherein said first and second connector halves are adapted to be mated or unmated while power is being supplied to at least said second connector half, wherein each of said first and second connector halves comprises:

a body;

a bladder positioned within said body, wherein said bladder is adapted to be filled with a fluid;

a stationary conductive member; and a movable conductive member that is adapted contact said stationary conductive member.

* * * * *

UNITED STATES PATENT AND TRADEMARK OFFICE

CERTIFICATE OF CORRECTION

PATENT NO. : 7,097,515 B2
APPLICATION NO. : 11/039126
DATED : August 29, 2006
INVENTOR(S) : Nadeem M. Siddiqi and Stuart John Morrison It is certified that error appears in the above-identified patent and that said Letters Patent is hereby corrected as shown below:

Col. 16, line 51 (claim 42, line 18), after "adapted" insert -- to conductively --.

Signed and Sealed this

Seventh Day of November, 2006

JON W. DUDAS
*Director of the United States Patent and Trademark Office*